US006980752B2

(12) United States Patent
Kamimura

(10) Patent No.: US 6,980,752 B2
(45) Date of Patent: Dec. 27, 2005

(54) DEVELOPING CARTRIDGE

(75) Inventor: Naoya Kamimura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/323,908

(22) Filed: Dec. 20, 2002

(65) Prior Publication Data

US 2003/0123899 A1 Jul. 3, 2003

(30) Foreign Application Priority Data

Dec. 28, 2001 (JP) ..... 2001-399712

(51) Int. Cl.[7] ..... G03G 15/08
(52) U.S. Cl. ..... 399/103; 399/105
(58) Field of Search ..... 399/103, 105, 399/276, 284

(56) References Cited

U.S. PATENT DOCUMENTS

| | | | | |
|---|---|---|---|---|
| 5,202,729 | A | 4/1993 | Miyamoto et al. | |
| 6,336,014 | B1 | 1/2002 | Sato et al. | 399/103 |
| 6,549,735 | B2 * | 4/2003 | Fujita et al. | 399/103 |

FOREIGN PATENT DOCUMENTS

| | | |
|---|---|---|
| JP | B2 62-31346 | 7/1987 |
| JP | 04-264575 | 9/1992 |
| JP | A 7-13411 | 1/1995 |
| JP | 08-106216 | 4/1996 |
| JP | 2001-60041 | 3/2001 |

OTHER PUBLICATIONS

U.S. patent application No. 10/106,238 filed Mar. 27, 2002. Concurrently filed U.S. patent application, Naoya Kamimura.

* cited by examiner

*Primary Examiner*—Hoang Ngo
(74) *Attorney, Agent, or Firm*—Oliff & Berridge, PLC

(57) ABSTRACT

A developing cartridge has a housing that accommodates developer therein. Rotatably mounted in the housing is a developing roller. The housing has side seals provided at each end of the developing roller that oppose the circumferential ends of the developing roller. The developing roller itself is divided into a seal region, a side-end region and a center region. A portion of the seal region and the side-end region found at each end of the developing roller with the seal region portions being at the ends of the roller and the side end region portions being between the seal region portions and the center region. Opposing the developing roller is a toner thickness regulating blade having a presser portion. The presser portion has a discontinuous cross-section such that a greater portion of the presser member contacts the developer roller in each portion of the side-end region then contacts the developer roller in the center region. As a result, a greater pressure is applied between the presser portion and the developer roller at the side-end region thereby resulting in less toner being applied to the developing roller to be carried to a photosensitive member. To further the minimize the amount of toner applied to the developing roller, the roughness in the side end region of the developing roller is smaller than the roughness in the center region and the hardness in the side end region of the developing roller is greater than the hardness in the center region. This combination of factors prevents toner from leaking from the housing at the ends of the developing rollers.

17 Claims, 9 Drawing Sheets

DEVELOPING CARTRIDGE

BACKGROUND OF THE INVENTION

1. Field of Invention

The invention relates to a developing cartridge which is applied to a laser printer.

2. Description of Related Art

U.S. Pat. No. 6,336,014 discloses a structure in which a developing cartridge accommodating toner is detachably attached to a printer. The developing cartridge includes a developing roller that supplies toner to a photosensitive medium and a supply roller that makes contact with the developing roller to supply toner to the developing roller. A layer thickness-regulating blade, which regulates the thickness of a toner layer formed on the surface of the developing roller makes contact with a circumferential surface of the developing roller. A lower film is disposed at a lower part of the developing roller along an axial direction of the developing roller.

The developing cartridge further includes side seals for preventing toner carried on the developing roller from leaking outside of the developing cartridge. The side seals are disposed at both ends of the developing roller with respect to its axial direction so as to make sliding contact with a circumferential surface of the developing roller at the both ends. The layer thickness-regulating blade prevents leakage of toner from an upper part of the developing roller. The lower film prevents leakage of toner from a lower part of the developing roller.

Inside the developing cartridge, toner is generally likely to build up at both ends of the developing roller more than at its center. When toner is moved to the layer thickness-regulating blade, the pressure that toner applies between the developing roller and the layer thickness-regulating blade becomes higher at both ends than at the center. Consequently, the thickness of toner held at both ends of the developing roller is greater than that at the center.

If the laser printer is used for a long term, toner held at both ends of the developing roller, especially near side seals, is scraped off by the side seals by the rotation of the developing roller and may result in toner leakage.

SUMMARY OF THE INVENTION

To address the above-identified problem, the invention is directed to a developing cartridge that has a housing accommodating developer therein. Mounted within the housing is a developing roller that is rotatably supported by the housing and carries the developer on a circumferential surface to a photosensitive drum. A side seal is provided in the housing at both ends of the developing roller so that the circumferential surface of the developing roller contacts the side seals. The developing roller is divided into a seal region, a side-end region and a center region. The side seal region and the side-end region are each divided so that a portion thereof is at each end of the developing roller with the seal region portions being at the outer ends and the side-end region portions being toward the center region of the developing roller. Each seal region portion, when the developing roller is mounted in the housing, is in contact with the side seal.

Opposing the developing roller is a toner thickness regulating blade. The blade comprises a plate mounted at one end to the housing and having at the other end a presser portion. The presser portion directly contacts the developing roller from the portion of the side-end region at one end of the developing roller through the center region to the portion of the side-end region at the other end of the developing region. Further, the presser portion has a discontinuous configuration or cross-section that differs between the portions opposing the side-end region portion and that opposing the center region. As a result, the thickness of toner that is applied to the developing roller in the side-end region is less than the thickness of toner applied at the center region. As such, the toner that comes into contact with the side seals is minimized and leakage is prevented.

To further limit the adherence of toner to the developing roller, the surface roughness of the developing roller in the side-end region is less than the roughness in the center region and the hardness in the side-end region is greater than the hardness in the center region. Because of this structure, toner is applied to the developing roller in the side-end regions is approximately one layer, or less, thick whereas in the center region it is multiple layers thick to thereby provide a good transference to the photosensitive drum and result in a high quality image.

BRIEF DESCRIPTION OF THE DRAWINGS

An embodiment of the invention will be described in detail with reference to the following figures, wherein.

DETAILED DESCRIPTION OF PREFERRED EMBODIMENTS

Figure 1:
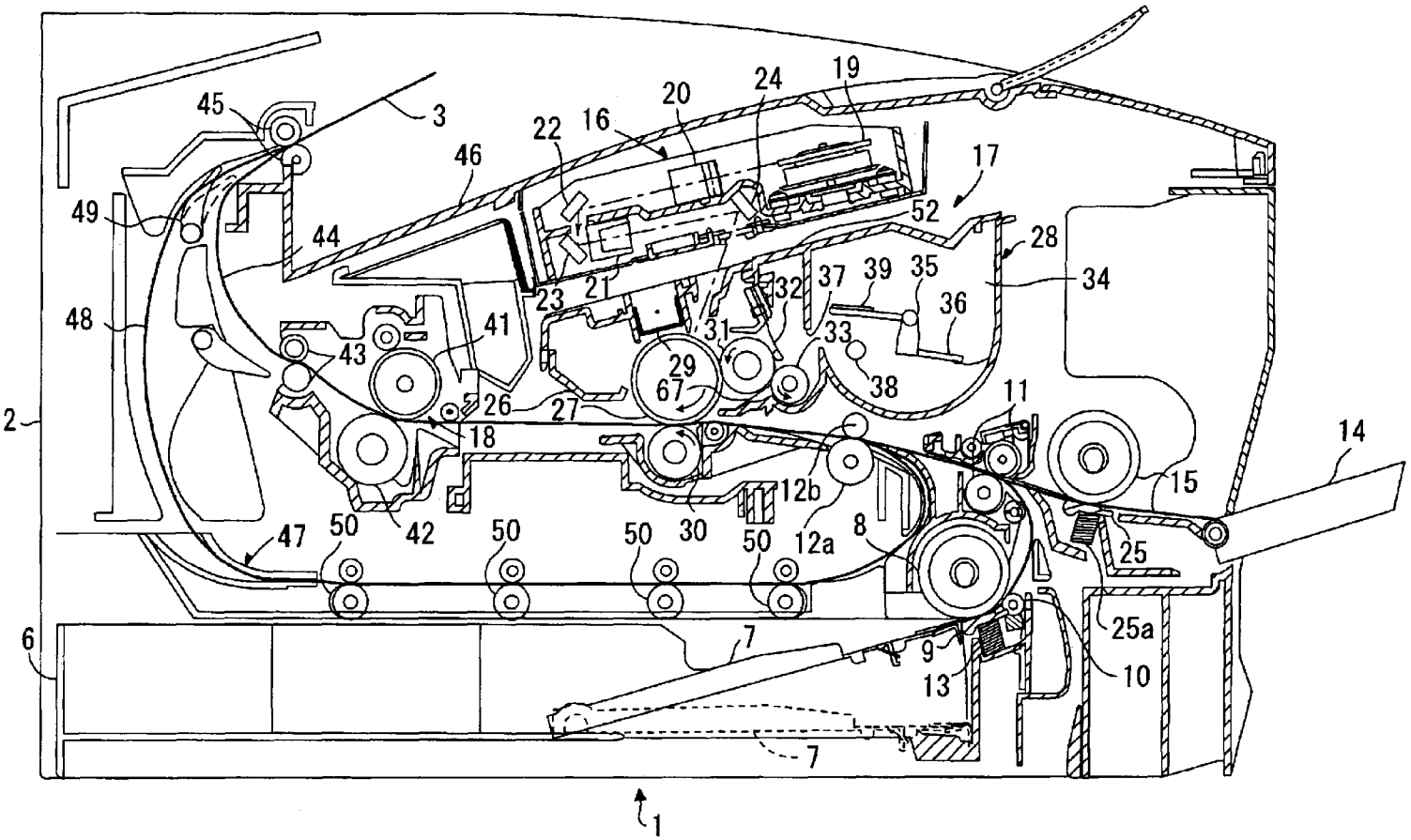
FIG. 1 is a side sectional view of the major parts of a laser printer according to one embodiment of the invention.

FIG. 1 is a side sectional view of the major parts of a laser printer 1 according to an embodiment of the invention. A sheet feed tray 6 is detachably attached to a bottom portion of a casing 2. A presser plate 7 is provided in the sheet feed tray 6 so as to support and upwardly press sheets 3 stacked in the sheet feed tray 6. A sheet feed roller 8 and a sheet feed pad 9 are provided above one end of the sheet feed tray 6, and register rollers 12 are provided downstream from the sheet feed roller 8 with respect to the sheet conveying direction.

The presser plate 7 allows sheets 3 to be stacked thereon. The presser plate 7 is pivotally supported at its end remote from the sheet feed roller 8 such that the presser plate 7 is vertically movable at its end closer to the sheet feed roller 8. The presser plate 7 is urged upwardly from its reverse side by a spring (not shown). When the stack of sheets 3 is increased in quantity, the presser plate 7 swings downwardly about the end of the presser plate 7 remote from the sheet feed roller 8, against the urging force from the spring. The sheet feed roller 8 and the sheet feed pad 9 are disposed facing each other. The sheet feed pad 9 is urged toward the sheet feed roller 8 by a spring 13 disposed on the reverse side of the sheet feed pad 9.

An uppermost sheet 3 in the stack on the presser plate 7 is pressed against the sheet feed roller 8 by the spring provided on the reverse side of the presser plate 7, and the uppermost sheet 3 is pinched between the sheet feed roller 8 and the sheet feed pad 9 when the sheet feed roller 8 rotates. Thus, the sheets 3 are fed one by one from the top of the stack.

After paper dust is removed from the sheet 3 by a paper dust removing roller 10, the sheet 3 is conveyed by conveyer rollers 11 to the register rollers 12*a*, 12*b*. The register rollers 12*a*, 12*b* are made up of two rollers, that is, a driving roller 12*a* provided for the casing 2 and a driven roller 12*b* provided for a process unit 17, which will be described later. The driving roller 12*a* and the driven roller 12*b* make surface-to-surface contact with each other. The sheet 3, conveyed by the conveyor rollers 11, is further conveyed downstream while being pinched between the driving roller 12*a* and the driven roller 12*b*.

The driving roller 12*a* is not driven before the sheet 3 makes contact with the driving roller 12*a*. After the sheet 3 makes contact with the driving roller 12*a* and the driving roller 12*a* corrects the orientation of the sheet 3, the driving roller 12*a* rotates and conveys the sheet 3 downstream.

A manual feed tray 14 from which sheets 3 are manually fed and a manual feed roller 15 that feeds sheets 3 stacked on the manual feed tray 14 are provided at the front of the casing 2. A separation pad 25 is disposed facing the manual feed roller 15. The separation pad 25 is urged toward the manual feed roller 15 by a spring 25*a* disposed on the reverse side of the separation pad 25. The sheets 3 stacked on the manual feed tray 14 are fed one by one while being pinched by the manual feed roller 15 and the separation pad 25 when the manual feed roller 15 rotates.

The casing 2 further includes a scanner unit 16, a process unit 17, and a fixing unit 18. The scanner unit 16 is provided in an upper portion of the casing 2 and has a laser emitting portion (not shown), a rotatable polygonal mirror 19, lenses 20, 21, and reflecting mirrors 22, 23, 24. A laser beam emitted from the laser emitting portion is modulated based on predetermined image data. The laser beam sequentially passes through or reflects from the optical elements, that is, the polygonal mirror 19, the lens 20, the reflecting mirrors 22, 23, the lens 21, and the reflecting mirror 24 in the order indicated by a broken line in FIG. 1. The laser beam is thus directed to and scanned at a high speed over the surface of a photosensitive drum 27, which will be described later.

Figure 2:
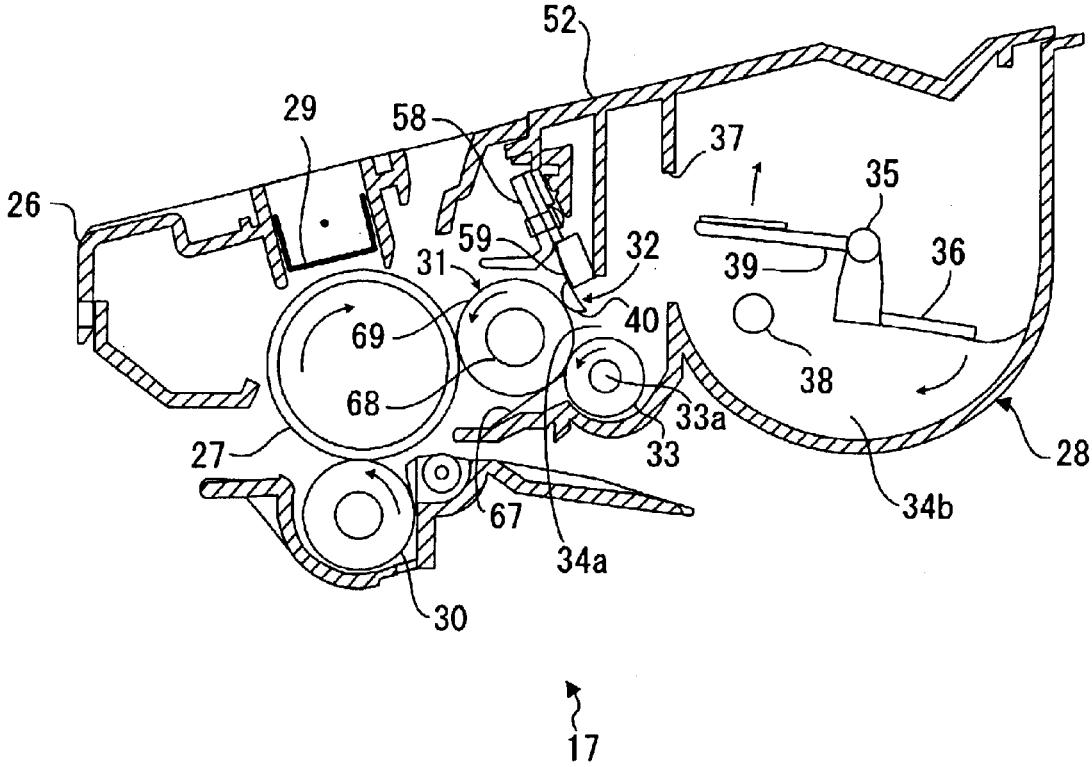
FIG. 2 is a side sectional view of the major parts of a process unit of the laser printer shown in FIG. 1.

FIG. 2 is an enlarged sectional view of the process unit 17. As shown in FIG. 2, the process unit 17 is disposed below the scanner unit 16 and has a drum cartridge 26 detachably attached to the casing 2 and a developing cartridge 28 detachably attached to the drum cartridge 26. The drum cartridge 26 includes the photosensitive drum 27, a scorotron charger 29, and a transfer roller 30.

The developing cartridge 28 includes a developing roller 31, a layer thickness-regulating blade 32, a supply roller 33, a developing chamber 34*a*, and a toner box 34*b*, all of which are provided within a housing 52 of the developing cartridge 28.

The toner box 34*b* contains positively charged nonmagnetic single-component toner, as a developing agent. The toner used in this embodiment is a polymerized toner obtained through copolymerization of styrene-based monomers, such as styrene, and acryl-based monomers, such as acrylic acid, alkyl (C1–C4) acrylate, alkyl (C1–C4) methacrylate, using a known polymerization method, such as suspension polymerization. The particle shape of such a polymerized toner is spherical, and thus the polymerized toner has excellent flowability.

A coloring agent, such as carbon black, and wax is added to the polymerized toner. An external additive, such as silica, is also added to the polymerized toner to improve flowability. The particle size of the polymerized toner is approximately 6–10 $\mu$m.

The toner in the toner box 34*b* is stirred by an agitator 36 supported by a rotating shaft 35 provided at a central portion of the toner box 34*b*, and is discharged from a toner supply port 37 opened on one side of the toner box 34*b*, toward the developing chamber 34*a*. A toner detection window 38 is provided on a side wall of the toner box 34*b*. The toner detection window 38 is wiped clean by a cleaner 39 supported by the rotating shaft 35.

The supply roller 33 is disposed diagonally downward from the toner supply port 37 so as to be rotatable in a counterclockwise direction. The developing roller 31 is disposed facing the supply roller 33 so as to also be rotatable in a counterclockwise direction. The supply roller 33 and the developing roller 31 are disposed in contact with each other so that they are press-deformed against each other to an appropriate extent.

Figure 5:
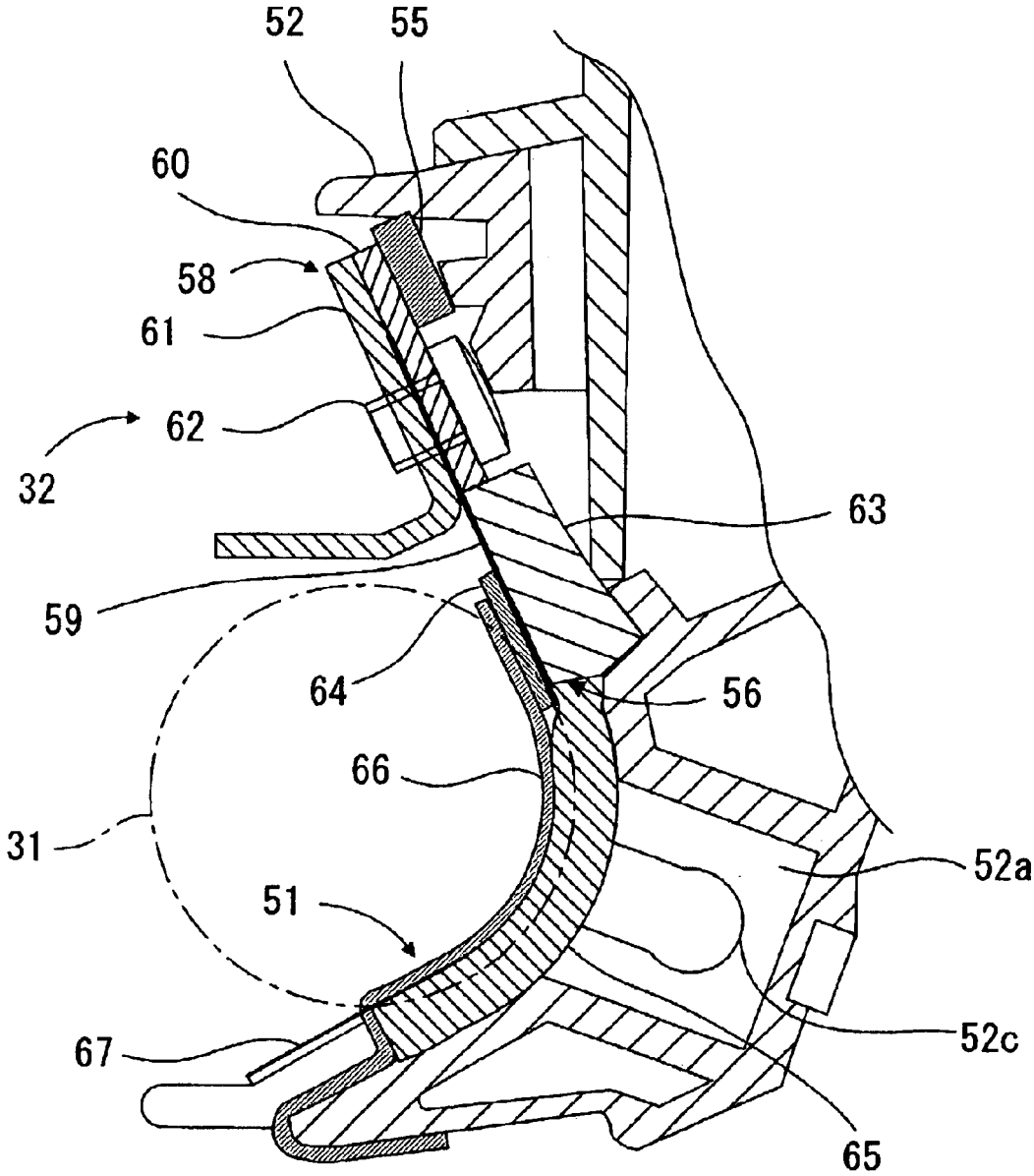
FIG. 5 is a side sectional view of the major parts of the sealing structure at the end of the cartridge when the developing roller is not mounted.
Figure 6:
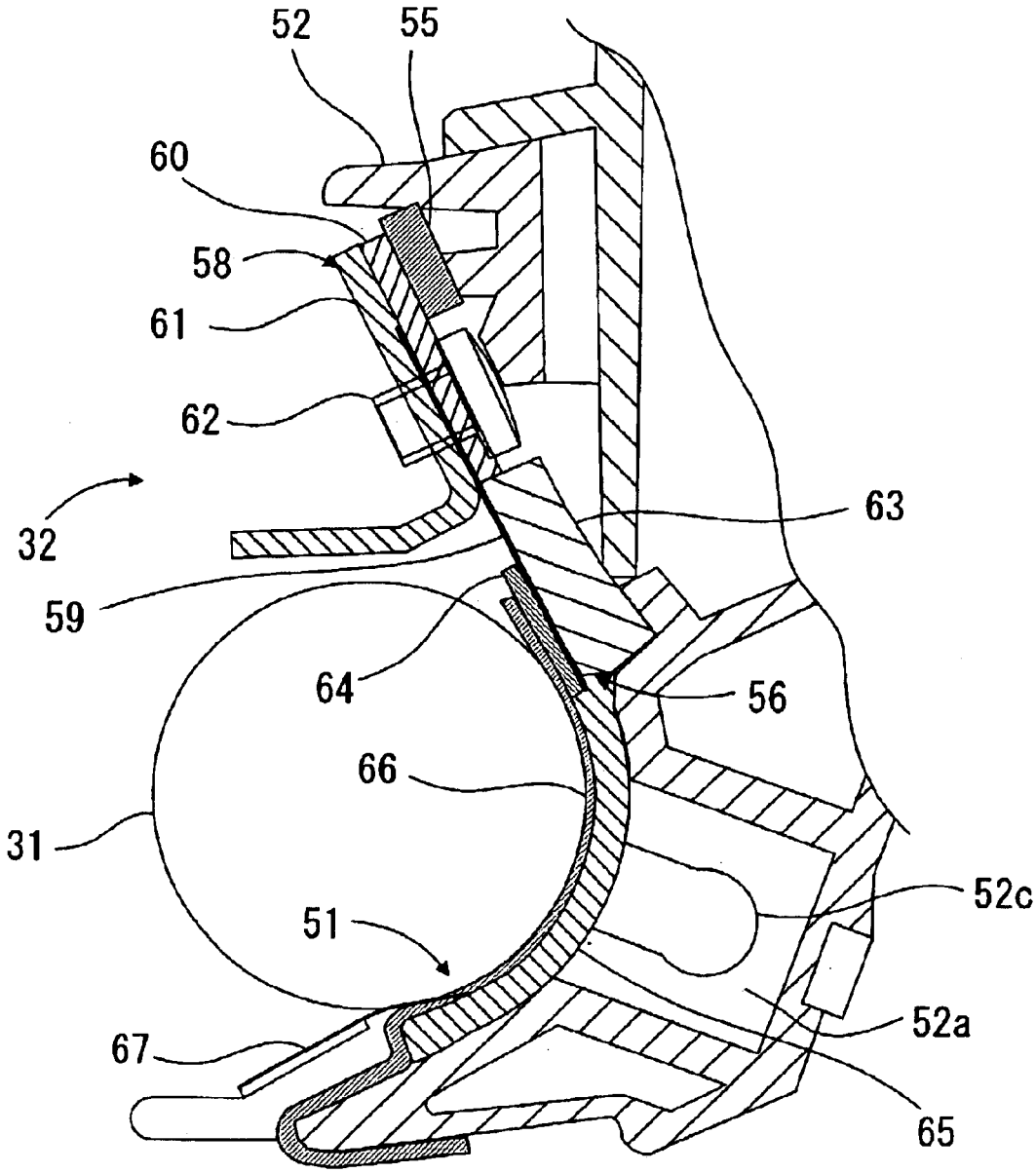
FIG. 6 is a side sectional view of the major parts of the sealing structure at the end of the cartridge when the developing roller is mounted.

The supply roller 33 is formed by covering a metallic shaft 33*a* with a conductive sponge material. Each of opposite ends of the shaft is rotatably supported by a support member 52*a* provided at each of opposite ends of the housing 52 along its width. The support member 52*a* is provided at the inside of a sidewall 53 formed at each of opposite ends of the housing 52 at a specified distance away from the sidewall 53. As shown in FIG. 5, the support member 52*a* is formed with a notch 52*c* to support the shaft 33*a* of the supply roller 33.

The developing roller 31 is formed by covering a metallic roller shaft 68 with a roller portion 69 made of an electrically conductive rubber material. More specifically, the roller portion 69 is made of an electrically conductive urethane rubber or silicone rubber containing fine carbon particles, and coated with a urethane rubber or silicone rubber containing fluorine. A predetermined developing bias is applied to the developing roller 31 with respect to the photosensitive drum 27. A layer thickness-regulating blade 32 is disposed near the developing roller 31 to regulate the thickness of a toner layer formed on the circumference surface of the developing roller 31. The layer thickness-regulating blade 32 has a metallic plate spring 59 and a presser portion 40.

Figure 3:
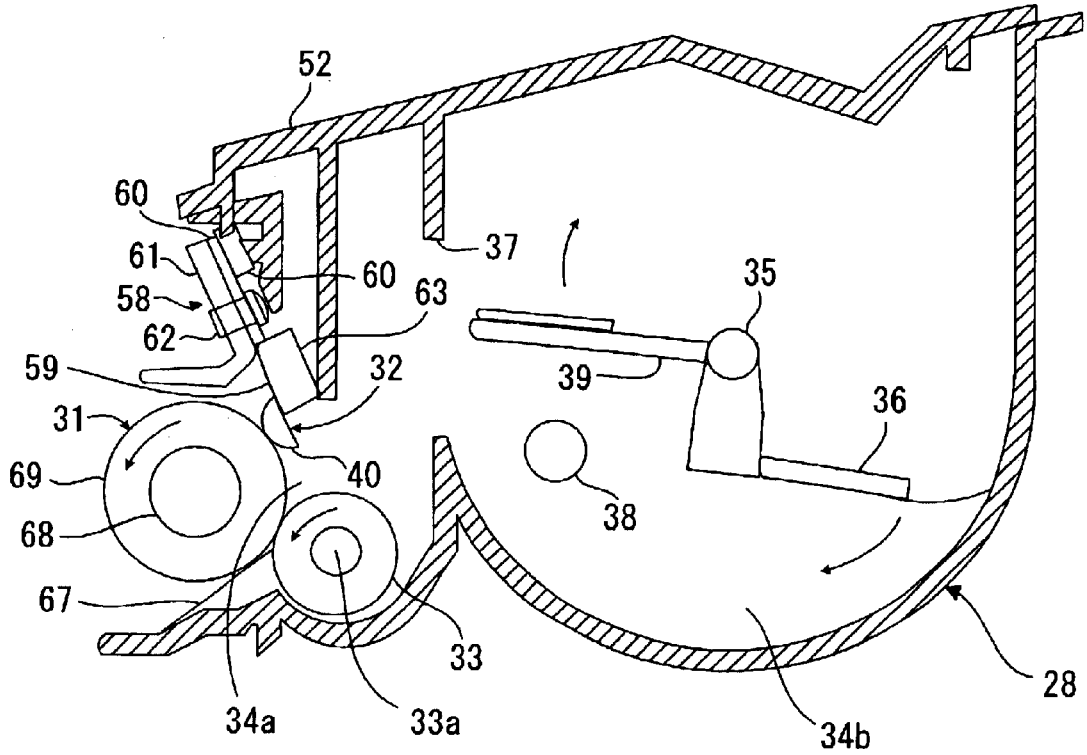
FIG. 3 is a side sectional view of the major parts of a developing cartridge in the process unit shown in FIG. 2.
Figure 7:
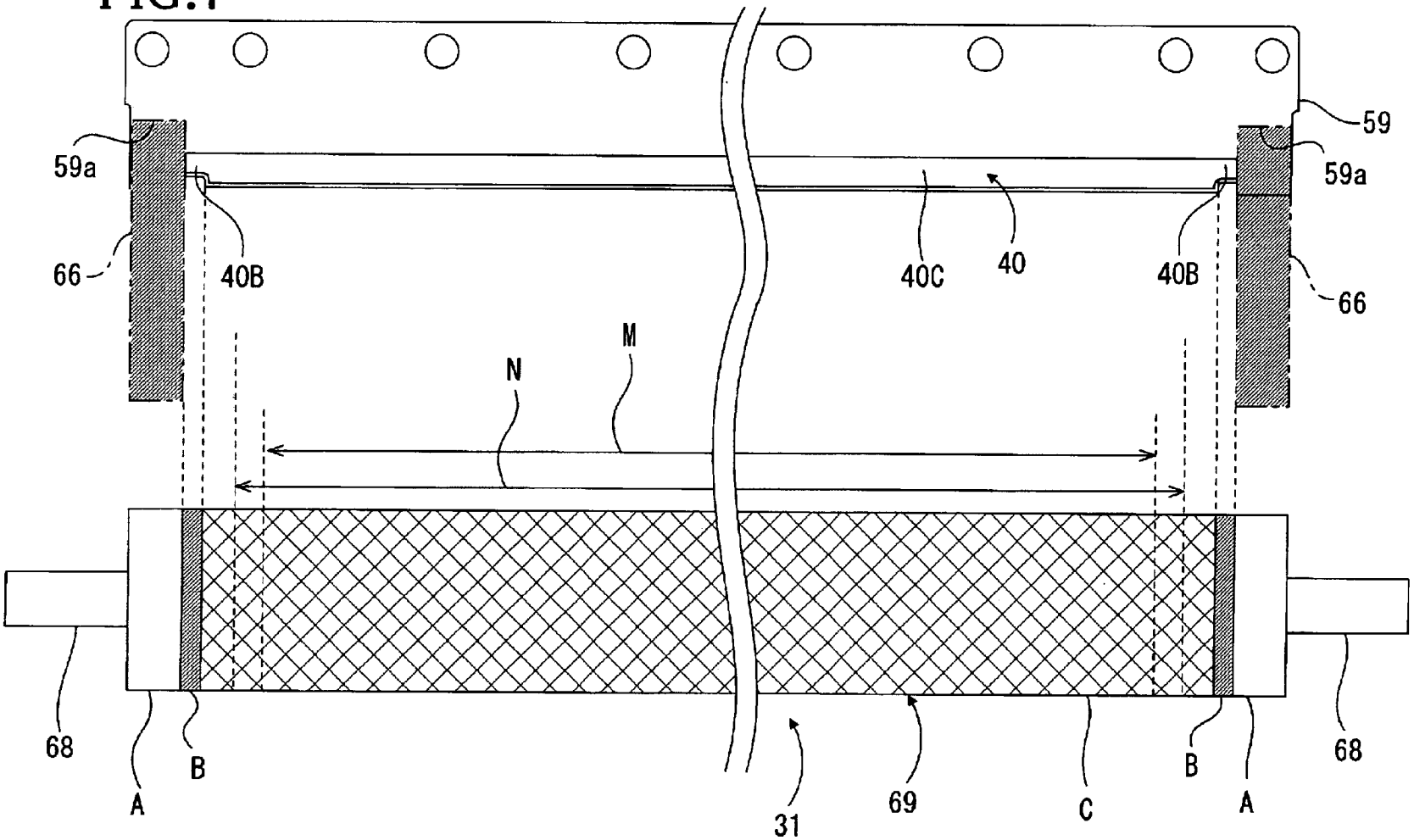
FIG. 7 shows a positional relationship between the developing roller and a layer thickness-regulating blade of FIG. 3 with respect to an axial direction.

The presser portion 40, formed in a substantially thin rectangular shape as shown in FIG. 7, is disposed on a distal end of the plate spring 59 and formed from an elastic member, such as an electrically insulative silicone rubber, into a semicircular shape in section. The plate spring 59, formed in a substantially rectangular shape as shown in FIG. 7, is supported to the housing 52 at its end opposite to the distal end of the plate spring 59 by a support member 58 so as to be close to the developing roller 31. The presser portion 40 is pressed against the developing roller 31 by an elastic force of the plate spring 59 as shown in FIG. 3. The developing roller 31 is supported rotatably in a direction from the distal end to the opposite end of the plate spring 59 as shown in FIG. 3.

The support member 58 is comprised of a back support member 60 formed in a plate extending along the axial direction of the developing roller 31, and a front support member 61, which has an L-shape in cross section, and is in a face-to-face relationship with the back support member 60. With the plate spring 59 sandwiched between the back support member 60 and the front support member 61, the support member 58 is secured to an upper part of the housing 52 using two screws 62.

As shown in FIGS. 2 and 3, toner discharged by the agitator 36 from the toner supply port 37 to the developing chamber 34*a* is supplied to the developing roller 31 when the supply roller 33 rotates. Toner is positively charged between the supply roller 33 and the developing roller 31 due to friction. Toner supplied to the developing roller 31 passes between the presser portion 40 and the developing roller 31 and is sufficiently positively charged therebetween due to friction. After passing between the presser portion 40 and the developing roller 31, toner is formed into a thin coating of toner of a predetermined thickness on the developing roller 31.

A photosensitive drum 27 is rotatably disposed, in a clockwise direction, at a drum cartridge 26 so as to be in contact with the developing roller 31. The photosensitive drum 27 is formed by coating a grounded cylindrical aluminum drum with a positively charged photosensitive layer made of polycarbonate.

A scorotron charger 29 is disposed at a predetermined interval upward from the photosensitive drum 27. The scorotron charger 29 produces corona discharge from a tungsten wire and positively charges the surface of the photosensitive drum 27 uniformly.

A transfer roller 30 is disposed below the photosensitive drum 27 and is rotatably supported, in a counterclockwise direction, by the drum cartridge 26 so as to face the photosensitive drum 27. The transfer roller 30 is formed by covering a metallic roller shaft with an electrically conductive rubber material. A power source (not shown) is electrically connected to the roller shaft such that a predetermined transfer bias is applied to the roller shaft when toner on the photosensitive drum 27 is transferred to the sheet 3.

As shown in FIG. 1, the fixing unit 18 is disposed downstream from the process unit 17 and has a heat roller 41, a pressure roller 42 pressed against the heat roller 41, and a pair of conveying rollers 43 provided downstream from the heat roller 41 and the pressure roller 42. The heat roller 41 is formed by an aluminum tube coated with a silicone rubber and a halogen lamp placed in the tube. Heat generated from the halogen lamp is transferred to the sheet 3 through the aluminum tube. The pressure roller 42 is made of a silicone rubber, which allows the sheet 3 to be easily removed from the heat roller 41 and the pressure roller 42.

The toner transferred to the sheet 3 by the process unit 17 is melted by the heat and becomes fixed onto the sheet 3, while the sheet 3 passes between the heat roller 41 and the pressure roller 42. After the fixation is completed, the sheet 3 is conveyed downstream by the conveying rollers 43.

An ejecting path 44 is formed downstream from the conveying rollers 43 to reverse the sheet conveying direction and guide the sheet 3 to an output tray 46 provided on the top surface of the laser printer 1. A pair of ejecting rollers 45 are provided at the upper end of the ejecting path 44 to eject the sheet 3 to the output tray 46.

The laser printer 1 is provided with a reverse conveying unit 47 that allows image forming on both sides of the sheet 3. The reverse conveying unit 47 includes the ejecting rollers 45, a reverse conveying path 48, a flapper 49, and a plurality of pairs of reverse conveying rollers 50.

The pair of ejecting rollers 45 can be switched between forward and reverse rotation. The ejecting rollers 45 rotate forward to eject the sheet 3 to the output tray 46, and rotate in reverse to reverse the sheet conveying direction.

The reverse conveying path 48 is vertically provided to guide the sheet 3 from the ejecting rollers 45 to the reverse conveying rollers 50 disposed above the sheet feed tray 6. The upstream end of the reverse conveying path 48 is located near the ejecting rollers 45, and the downstream end of the reverse conveying path 48 is located near the reverse conveying rollers 50.

The flapper 49 is swingably provided adjacent to a point branching into the ejecting path 44 and the reverse conveying path 48. The flapper 49 can be shifted between a first position shown by a solid line and a second position shown by a broken line in FIG. 1. The flapper 49 is shifted by switching the excited state of a solenoid (not shown).

When the flapper 49 is at the first position, the sheet 3 is guided along the ejecting path 44 and ejected by the ejecting rollers 45 to the output tray 46. When the flapper 49 is at the second position, the sheet 3 is conveyed to the reverse conveying path 48 by the ejecting rollers 45 rotating in reverse.

A plurality of pairs of reverse conveying rollers 50 are provided above the sheet feed tray 6 in a horizontal direction. A pair of reverse conveying rollers 50 on the most upstream side are located near the lower end of the reverse conveying path 48. A pair of reverse conveying rollers 50 on the most downstream side are located below the register rollers 12.

The operation of the reverse conveying unit 47 when an image is formed on the both sides of the sheet 3 will be described. The sheet 3 with a printed image on one side thereof is conveyed by the conveying rollers 43 along the ejecting path 44 toward the ejecting rollers 45. At this time, the flapper 49 is located at the first position. The ejecting rollers 45 rotate forward while pinching the sheet 3 to convey the sheet 3 temporarily toward the output tray 46. The ejecting rollers 45 stop rotating forward when the sheet 3 is almost ejected to the output tray 46 and the trailing edge of the sheet 3 is pinched by the ejecting rollers 45. In this state, the flapper 49 is shifted to the second position, and the ejecting rollers 45 rotate in reverse. The sheet 3 is conveyed in the reverse direction along the reverse conveying path 48. After the entire sheet 3 is conveyed to the reverse conveying path 48, the flapper 49 is shifted to the first position.

After the above actions have occurred, the sheet 3 is conveyed to the reverse conveying rollers 50, and conveyed upward by the reverse conveying rollers 50 to the register rollers 12. The sheet 3 is then conveyed to the process unit 17 with its printed side facing down. As a result, an image is printed on both sides of the sheet 3.

The image forming operation will now be described. The surface of the photosensitive drum 27 is uniformly positively charged by the scorotron charger 29. The surface potential of the photosensitive drum 27 is approximately 900 V. When the surface of the photosensitive drum 27 is irradiated with a laser beam emitted from the scanner unit 16, electric charge is removed from a portion exposed to the laser beam, and the surface potential of the exposed portion becomes approximately 200V. In this way, the surface of the photosensitive drum 27 is divided into a high-potential portion (unexposed portion) and a low-potential portion (exposed portion), and thereby an electrostatic latent image is formed.

The surface potential of the unexposed portion is approximately 900 V, while the surface potential of the exposed portion is approximately 200 V.

When positively charged toner on the developing roller 31 faces the photosensitive drum 27, the toner is supplied to the low-potential exposed portion of the photosensitive drum 27. As a result, the electrostatic latent image formed on the photosensitive drum 27 is visualized.

The developing roller 31 reclaims the toner remaining on the surface of the photosensitive drum 27. The remaining toner is the toner that has been supplied to the photosensitive drum 27 but not transferred by the transfer roller 30 from the photosensitive drum 27 to the sheet 3. The remaining toner adheres to the developing roller 31 by a Coulomb force generated due to a potential difference between the photosensitive drum 27 and the developing roller 31, and is reclaimed into the developing cartridge 28. With this method, a scraper that scrapes the remaining toner from the photosensitive drum 27 and a storage place for the scraped toner are not required. Thus, a laser printer can be simplified in structure and made compact. Further the manufacturing cost is reduced.

While the sheet 3 is passing between the photosensitive drum 27 and the transfer roller 30, the toner forming a visualized image on the photosensitive drum 27 is transferred to the sheet 3 by a Coulomb force generated due to a potential difference between the potential of the sheet 3 and the surface potential of the photosensitive drum 27.

The sheet 3 is conveyed to the fixing unit 18 and as described above, the toner on the sheet 3 melted by the heat to be fixed onto the sheet 3. After passing along the ejecting path 44, the sheet 3 where the toner is fixed is ejected to the output tray 46.

Side seals 51 are disposed at both ends of the inside of the housing 52 with respect to an axial direction of the developing roller 31. When the developing roller 31 is mounted in position at the developing cartridge 28, the side seals 51 prevent toner carried on the developing roller 31 from leaking from both ends of the developing roller 31.

Referring to FIGS. 4A to 6, the sealing structure at each end of the inside of the developing cartridge 28, with respect to the axial direction of the developing roller 31, will be described. FIGS. 4A to 6 show structural elements at only one side of the inside of the developing cartridge 28, and the following descriptions are made based on the one side of the inside of the developing cartridge 28. The structural elements at the one side are identical to those at the other side.

Figure 4A:
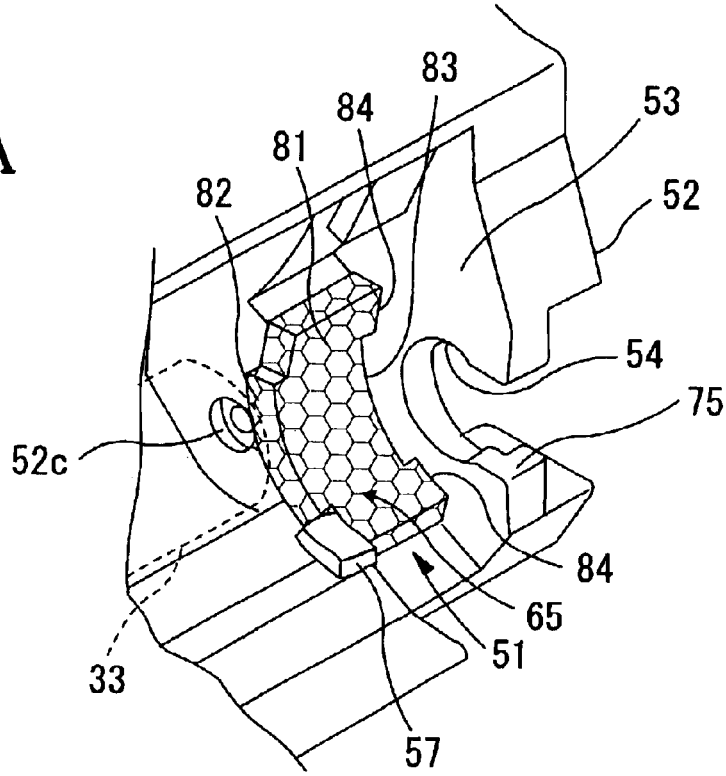
FIG. 4A is a perspective view of the major parts of a sealing structure at an end of the cartridge shown in FIG. 3 with respect to an axial direction of the developing roller to be mounted in the cartridge, where a sponge seal of a side seal is affixed and the supply roller is detached.
Figure 4B:
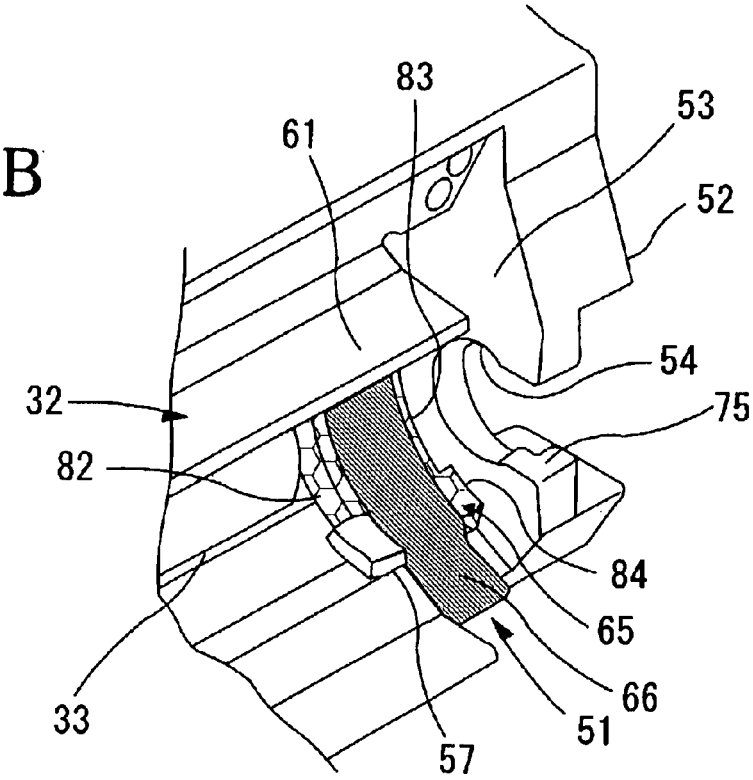
FIG. 4B is a perspective view of the major parts of the sealing structure at the end of the cartridge, where a sealing element is overlaid on the sponge seal and the supply roller is attached.

As shown in FIGS. 4A and 4B, a housing 52, constituting the developing cartridge 28 is open at a front side. A side wall 53 of the housing 52 is provided with a support hole 54 by which the developing roller 31 is mounted in the housing 52. Adjacent to the side wall 53, the side seal 51, an upper side seal 55, a blade side seal 56 (FIG. 5), and a lower side seal 57 are provided, all of which reliably prevent toner from leaking from each end of the developing roller 31 when mounted in position in the developing cartridge 28. The support hole 54 has an opening 75 at a front side thereof and is formed so as to receive the roller shaft 68 of the developing roller 31 along the opening 75.

The upper side seal 55 is made of a sponge material (e.g. urethane) formed in a substantially rectangular shape having a fixed thickness. As shown in FIG. 5, the upper side seal 55 is disposed facing the support member 58 at an upper portion of the end of the housing 52, and affixed to the housing 52 with double-faced adhesive tape. Provision of the upper side seal 55 can improve the adhesion of the blade side seal 56.

The blade side seal 56 is provided, at both ends of the layer thickness-regulating blade 32, facing the upper side seal 55 at an end of the plate spring 59 of the layer thickness-regulating blade 32. The blade side seal 56 is made up of a back blade seal 63 provided on a rear surface of the plate spring 59 and a front blade seal 64 provided on a front surface of the plate spring 59.

The back blade seal 63 is made of a sponge material (e.g. urethane) formed in a substantially rectangular shape having a fixed thickness. The back blade seal 63 is affixed to the rear surface of the plate spring 59 facing the upper side seal 55, with double-faced adhesive tape. The back blade seal 63 and the upper side seal 55 are made of sponge material and make contact with each other, thereby preventing the toner from leaking from the upper part of each end of developing roller 31 when mounted in position. The gap shown in FIG. 5 is only due to the cross section being shown at the screw 62 and does not occur elsewhere.

The front blade seal 64 is made of a sponge material (e.g. urethane) formed in a substantially rectangular shape having a fixed thickness, and is affixed to the plate spring 59 facing the back blade seal 63 with double-faced adhesive tape.

As shown in FIGS. 4A and 4B, the lower side seal 57 is made of a sponge material (e.g. urethane) formed in a substantially rectangular shape having a fixed thickness, disposed adjacent to an inner side of the side seal 51, and affixed to a lower part of the housing 52 with double-faced adhesive tape. Provision of the lower side seal 57 can prevent the toner from leaking from a boundary between the side seal 51 and a lower film 67 shown in FIG. 3.

The side seal 51 is provided adjacent to the side wall 53 of the housing 52 so as to make sliding contact with a circumferential surface at the end the developing roller 31. The side seal 51 is comprised of a sponge seal 65, and a sealing element 66 overlaid on the sponge seal 65.

The sponge seal 65, providing an urging force, is made of an elastic foamed material, i.e., a sponge material such as urethane. More specifically, it is made of a high density, microcellular urethane foam (trade name: Poron, manufactured by Rogers Inoac Corporation), which has a comparatively great rigidity and resists permanent deformation among various sponge materials. Its hardness is 0.001 to 0.05 MPa (Mega-Pascal) under 25% compressive load, and preferably 0.005 to 0.025 MPa. The sponge seal 65 is formed in a substantially rectangular shape having a certain thickness to generate a fixed pressing force when compressed by the developing roller 31 mounted in position.

The sponge seal 65 includes a base portion 81 and a projecting portion 82 which are formed integrally as shown in FIGS. 4A and 4B. The base portion 81 is formed in a substantially rectangular shape, and the top surface thereof is used as a surface to affix the sealing element 66. The projecting portion 82 is formed in a rectangular shape projecting from a center of the base portion 81, with respect to a rotational direction of the developing roller 31, toward the center of the developing roller 31 along its axial direction.

The base portion 81 is provided with a rectangular recess 83 on the side of the base portion 81 opposite the projecting portion 82. The sponge seal 65 is disposed in such a manner that an end portion 84 on the same side of the sponge seal 65 as the recess 83 makes contact with the sidewall 53 of the housing 52, thereby positioning the sponge seal 65 with respect to the width of the housing 52.

The sponge seal 65 is affixed to the housing with double-faced adhesive tape with an upper end of the sponge seal 65 pressed against the back blade seal 63 and the front blade seal 64 as shown in FIG. 5. A lower end of the sponge seal 65 and the lower side seal 57 slightly overlap each other in the width direction of the housing 52 as shown in FIG. 4A.

The sponge seal 65, the back blade seal 63, and the front blade seal 64, are all made of sponge materials. With this structure, when the upper end of the sponge seal 65 is pressed against the back blade seal 63 and the front blade seal 64, sponge materials make contact with each other to reliably prevent toner leakage in the boundaries between the sponge seal 65, the back blade seal 63, and the front blade seal 64.

By making the lower end of the sponge seal 65 and the lower side seal 57 overlap each other, the sponge materials make contact with each other, thereby preventing toner leakage in the boundary between the sponge seal 65 and the lower side seal 57.

The sealing element 66 is formed into a substantially rectangular-shaped flat sheet having flexibility, and made of a textile of cashmere-base fibers. As shown in FIG. 4B, the sealing element 66 is overlaid on the sponge seal 65, adjacent to the sidewall 53 at an end of the housing 52. As shown in FIG. 5, the sealing element 66 covers the bottom of the front blade seal 64 and a lower end of the plate spring 59, covers the sponge seal 65 at a lower end thereof, further extends downwardly from the sponge seal 65, and rolls up the lower end of the housing 52. The sealing element 66 is affixed with double-faced adhesive tape. As the upper end of the sealing element 66 is affixed to the lower part of the spring plate 59 in this manner, the gap between the sealing element 66 and the spring plate 59 can be eliminated, and leakage of toner from the side seal 51 can be more reliably prevented.

As the upper end of the sealing element 66 covers the front blade seal 64, toner can be reliably prevented from laterally leaking from the presser portion 40 of the layer thickness-regulating blade 32. As the sealing element 66 moves in accordance with the plate spring 59 of the layer thickness-regulating blade 32, the movement of the plate spring 59 is not limited, and the presser portion 40 is normally pressed against the developing roller 31 under a preferable condition. Thus, the layer of toner formed on the developing roller 31 becomes uniform.

The front blade seal 64 interposed between the sealing element 66 and the plate spring 59 can be adequately compressed because it is made of sponge material. The front blade seal 64 can effectively absorb a reactive force of a pressing force between the sealing element 66 and the developing roller 31, thereby reliably obtaining the toner sealability between the sealing element 66 and the developing roller 31.

The sealing element 66 is placed over the front blade seal 64. When the front blade seal 64 and the sealing element 66 are layered, they are compressed in use but even in the compressed state a total thickness of them both is thicker than the thickness of the presser portion 40 of the layer thickness-regulating blade 32. With this structure, toner can be prevented from laterally leaking from between the presser portion 40 and the developing roller 31, even if the presser portion 40 is worn by friction with the developing roller 31.

The end of the housing 52 where the side seal 51 is provided is formed in a curved shape along the circumferential surface of the developing roller 31 so as to bring the side seal 51 into contact with the developing roller 31. The sponge seal 65 and the sealing element 66 are layered along the curved shape, thus, the sealing element 66 is curved along the circumferential surface of the developing roller 31.

The developing roller 31 is rotatably mounted in the housing 52 by inserting the roller shaft 68 of the developing roller 31 along and into the support hole 54 from the front face where the housing 52 is open, as shown in FIG. 4B. Thus, the developing roller 31 can rotate in a state that the circumferential surface of the developing roller 31 makes sliding contact with the sealing element 66 at each end. While the developing roller 31 rotates, toner does not leak from between the developing roller 31 and the sealing element 66 at each end of the developing roller 31, thereby ensuring sufficient toner sealability.

The lower film 67 is made of a polyethylene terephthalate (PET) sheet or an urethane rubber film, and affixed, with double-faced adhesive tape, entirely to a top face of the lower part of the housing 52, as shown in FIGS. 2 and 3. The lower film 67 prevents toner from leaking from the lower part of the housing 52.

The developing roller 31 will now be described. As shown in FIG. 7, a roller portion 69 of the circumferential surface of the developing roller 31 is divided into three regions defined respectively as a seal region A, a side-end region B, and a center region C, with respect to the axial direction of the developing roller 31.

The seal region A has a portion located at each end of the roller portion 69, and corresponds to a region that makes sliding contact with the sealing elements 66 when the developing roller 31 is attached to the housing 52. Each portion of the seal region A is equal in width to the sealing element 66 from the edge of the roller portion 69 toward the center thereof with respect to the axial direction. In the seal region A of the roller portion 69, the surface roughness is smaller than or equal to 2 $\mu$m (mean roughness depth Rz), and a hardness is greater than or equal to 50 Hs (Japanese Industrial Standards, JIS, A).

A portion of the side-end region B is located at each end of the roller portion 69 adjacent to the seal region A but toward the center of the developing roller 31. The side-end region B is defined as a region which does not overlap a first region M corresponding to a region where an electrostatic latent image is formed on the photosensitive drum 27 nor a second region N corresponding to a maximum width of the sheet 3 used in the laser printer 1.

In the side-end region B of the roller portion 69, a surface roughness is smaller than or equal to 2 $\mu$m (mean roughness depth Rz), and a hardness is greater than or equal to 50 Hs (JIS A).

The center region C is a region enclosed by the portion of the side-end region B located at each end of the roller portion 69. In the center region C, the surface roughness is greater than that in the seal region A and the side-end region B, and specifically is 3 to 9 $\mu$m (mean roughness depth Rz). The hardness in the center region C is smaller than that in the seal portion A and the side-end portion B, and specifically is 30 to 50 Hs (JIS A).

The developing roller 31, including the seal region A, the side-end region B, and the center region C of which the surface roughness and the hardness are different, is produced as follows:

A roller corresponding to regions A and B, of which the hardness is great, and another roller corresponding to region C, of which the hardness is small, are separately formed, and connected together around a metallic shaft 68 to be integrally formed as the roller portion 69.

The entire surface of the roller portion 69 is ground, and a portion corresponding to the seal region A and the side-end region B is further ground. Then, a coating containing fluorine is applied to the entire surface of the roller portion 69.

In the developing roller 31 produced in this manner, as the surface roughness in the side-end region B is smaller than that in the center region C, the surface in the side-end region B is smoother than that in the center region C, and toner is less prone to be held in the side-end region B. When a toner layer is formed by the layer thickness-regulating blade 32, the amount of toner per unit area (M/A) held in the side-end region B becomes less than that in the center region C.

As the surface roughness in the seal region A is smaller than that in the center region C, the surface in the seal region A is smoother than that in the center region C. Thus, the contact between the sealing element 66 and the developing roller 31 in the seal region A becomes more intimate and leakage of toner is effectively prevented.

In addition, as the hardness in the side-end region B is greater than that in the center region C, the surface in the side-end region B is smoother than that in the center region C, toner is less prone to be held in the side-end region B. When a toner layer is formed by the layer thickness-regulating blade 32, the amount of toner per unit area (M/A) held in the side-end region B becomes less than that in the center region C.

Further, as the hardness in the seal region A is greater than that in the center region C, the surface in the seal region A is harder than that in the center region C. Thus, the contact between the sealing element 66 and the developing roller 31 in the seal region A becomes more intimate and leakage of toner is effectively prevented.

As shown in FIG. 7, the plate spring 59 is formed with recesses 59*a* at each side thereof so as to abut with the affixed sealing elements 66. In accordance with this, the presser portion 40 is also provided with recesses at both ends thereof. The recesses of the presser portion 40 function as side-end presser portions 40B, which press against the side-end region B of the developing roller 31. A center portion of the presser portion 40 between the side-end presser portions 40B functions as a center presser portion 40C, which presses against the center region C of the developing roller 31.

Each side-end presser portion 40B has a width equal to the opposing side-end region B of the developing roller 31, and the center presser portion 40C has a width equal to the center region C of the developing roller 31.

Figure 9A:
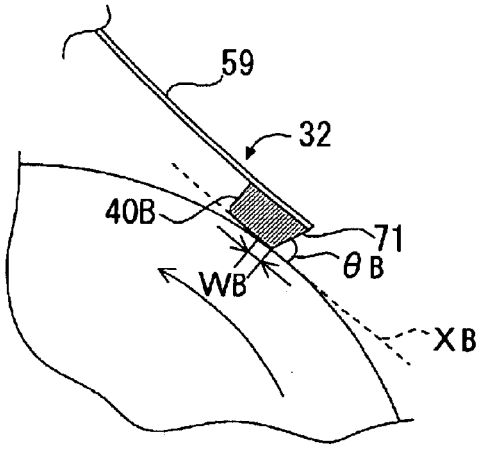
FIG. 9A is a cross section of a second embodiment of the presser portion shown in FIG. 7 showing a contact portion with the developing roller at the side-end presser portion.
Figure 9B:
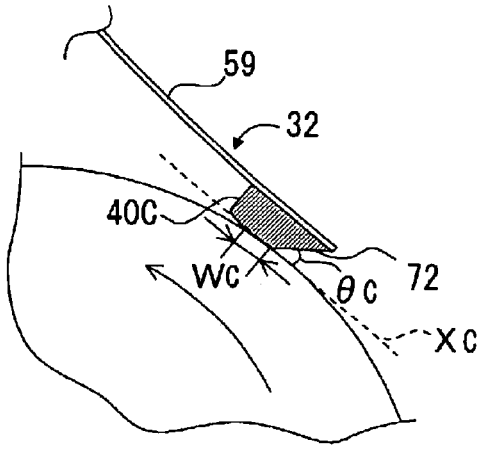
FIG. 9B is a cross section of the second embodiment of the presser portion shown in FIG. 7 showing a contact portion with the developing roller at the center presser portion.

The side-end presser portions 40B and the center presser portion 40C are formed in a discontinuous chain having different forms in cross section. FIG. 9A illustrates a nip portion between the side-end presser portion 40B and the developing roller 31 in an enlarged view. FIG. 9B illustrates a nip portion between the center presser portion 40C and the developing roller 31 in an enlarged view.

In FIGS. 9A and 9B, upstream end portions of the side-end presser portion 40B and the center presser portion 40C with respect to the rotational direction of the developing roller 31 are formed having flat surfaces respectively in cross section. Assuming that an angle formed by an upstream end portion 71 of the side-end presser portion 40B and a tangent line $X_B$ of the developing roller 31 at the nip portion is $\theta_B$ and an angle formed by an upstream end portion 72 of the center presser portion 40C and a tangent line $X_C$ at the nip portion is $\theta_C$, $\theta_C<\theta_B$ is established. To form a toner layer on the developing roller 31 with a desired thickness, it is preferable that angles $\theta_B$ and $\theta_C$ are set to less than 90°.

By setting $\theta_C<\theta_B$, a nip width $W_B$ of which the side-end portion 40B makes contact with the developing roller 31 becomes shorter than a nip width $W_C$ of which the center presser portion 40C makes contact with the developing roller 31 with respect to the rotational direction of the developing roller 31. As a result, a pressing force per unit area of the side-end presser portion 40B that acts on the side-end region B becomes greater than that of the center presser portion 40C that acts on the center region C.

Toner supplied onto the surface of the developing roller 31 by the supply roller 33 is moved in the rotational direction of the developing roller 31 in contact with the presser portion 40 of the layer thickness-regulating blade 32. In the side-end region B of the developing roller 31, a large quantity of toner is scraped by the side-end presser portions 40B applying a great pressure thereto. In the center region C of the developing roller 31, a small quantity of toner is scraped by the center presser portion 40C applying a smaller pressure thereto.

Therefore, the amount of toner per unit area (M/A) held on the surface of the developing roller 31 after passing the layer thickness-regulating blade 32 is less in the side-end region B than in the center region C. With this condition, toner is brought to face the photosensitive drum 27.

Figure 10A:
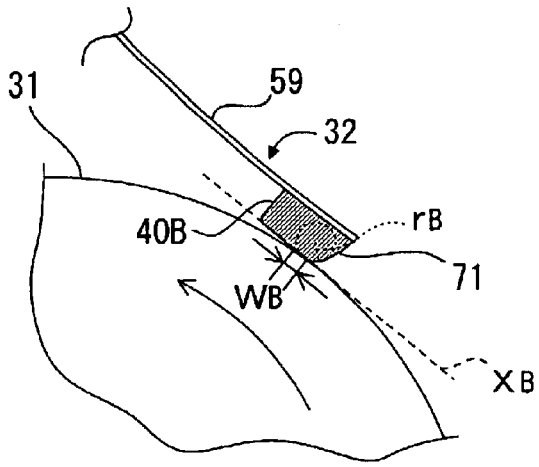
FIG. 10A is a cross section of a third embodiment of the presser portion shown in FIG. 7 showing a contact portion with the developing roller at the side-end presser portion.
Figure 10B:
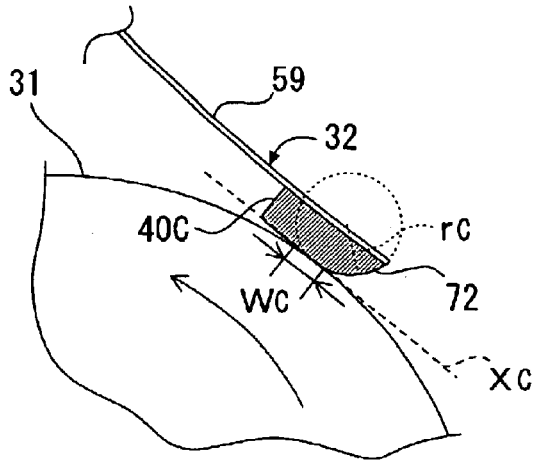
FIG. 10B is a cross section of the third embodiment of the presser portion shown in FIG. 7 showing a contact portion with the developing roller at the center presser portion.

FIGS. 10A and 10B show the upstream end portion 71 of the side-end presser portion 40B and the upstream end portion 72 of the center presser portion 40C as formed to have curved surfaces in cross section. Assuming a radius of curvature of the upstream end portion 71 of the side-end presser portion 40B is $r_B$ as shown in FIG. 10A and a radius of curvature of the upstream end portion 72 of the center presser portion 40C is $r_C$ as shown in FIG. 10B, the relationship $r_B<r_C$ is established.

By setting $r_B<r_C$, the nip width $W_B$ with which the side-end portion 40B makes contact with the developing roller 31 becomes shorter than the nip width $W_C$ with which the center presser portion 40C makes contact with the developing roller 31 with respect to the rotational direction of the developing roller 31. As a result, a pressing force per unit area of the side-end presser portion 40B that acts on the side-end region B becomes greater than that of the center presser portion 40C that acts on the center region C.

Toner supplied onto the surface of the developing roller 31 by the supply roller 33 is moved toward the rotational direction of the developing roller 31, making contact with the presser portion 40 of the layer thickness-regulating blade 32. In the side-end region B of the developing roller 31, a large amount of toner is scraped by the side-end presser portions 40B applying a great pressure. In the center region C of the developing roller 31, a small amount of toner is scraped by the center presser portion 40C applying a small pressure.

Therefore, the amount of toner per unit area (M/A) held on the surface of the developing roller 31 after passing the layer thickness-regulating blade 32 is less in the portions of the side-end region B than in the center region C. With this condition, toner is brought to face the photosensitive drum 27.

Figure 8A:
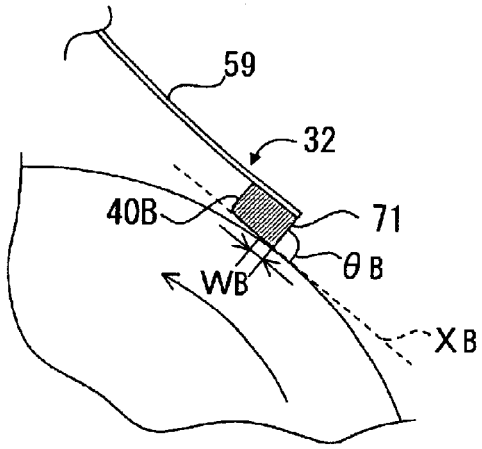
FIG. 8A is a cross section of a first embodiment of a presser portion shown in FIG. 7 showing a contact portion with the developing roller in a side-end presser portion.
Figure 8B:
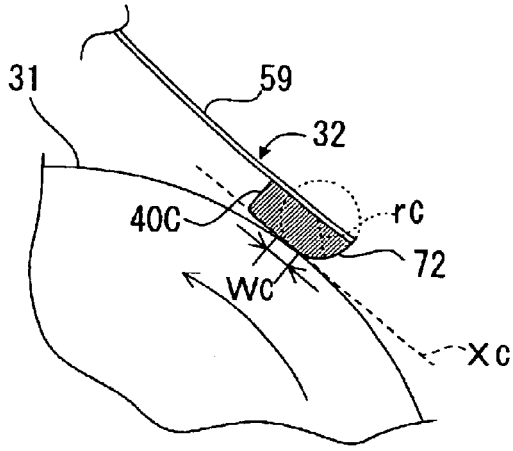
FIG. 8B is a cross section of the first embodiment of the presser portion shown in FIG. 7 showing a contact portion with the developing roller in a center presser portion.

On the other hand, one of the upstream end portions 71, 72 can be formed with a flat surface and the other one can be formed with a curved surface. In FIG. 8A, the side-end presser portion 40B is formed with a substantially rectangular cross section, the upstream end portion 71 is formed in a flat surface, and the angle $\theta_B$ formed by the upstream end portion 71 and the tangent line $X_B$ of the developing roller 31 is 90 degrees. In FIG. 8B, the center presser portion 40C is formed in substantially a rectangular cross section, the upstream end portion 72 is formed with a curved surface, and the curvature radius $r_C$ of the upstream end portion 72 is 1.5 mm.

The nip portion between the side-end presser portion 40B and the developing roller 31 and the nip portion between the center presser portion 40C and the developing roller 31 are disposed on the same line in the axial direction of the developing roller 31.

Even with the above arrangement, as is the case with FIGS. 9A, 9B and 10A, 10B, the nip width $W_B$ between the side-end presser portion 40B and the developing roller 31 is shorter than the nip width $W_C$ between the center presser portion 40C and the developing roller 31 with respect to the rotational direction of the developing roller 31. As a result, a pressing force per unit area of the side-end presser portion 40B that acts on the side-end region B becomes greater than that of the center presser portion 40C that acts on the center region C.

Toner supplied onto the surface of the developing roller 31 by the supply roller 33 is moved toward the rotational direction of the developing roller 31, making contact with the presser portion 40 of the layer thickness-regulating blade 32. In the side-end region B of the developing roller 31, a large amount of toner is scraped by the side-end presser portions 40B applying a great pressure thereto. In the center region C of the developing roller 31, a small amount of toner is scraped by the center presser portion 40C applying a small pressure thereto. Therefore, the amount of toner per unit area (M/A) held on the surface of the developing roller 31 after passing the layer thickness-regulating blade 32 is less in the side-end region B than in the center region C. With this condition, toner is brought to face the photosensitive drum 27.

As described above, in any arrangement shown in FIGS. 8A to 10B, the angle between the tangent line of the developing roller 31 and the upstream end portion 71 of the side-end presser portion 40B becomes greater than the angle between the tangent line of the developing roller 31 and the upstream end portion 72 of the center presser portion 40C. That is, the nip width $W_B$ between the side-end presser portion 40B and the developing roller 31 becomes shorter than the nip width $W_C$ between the center presser portion 40C and the developing roller 31 with respect to the rotational direction of the developing roller 31. Thus, the pressing force per unit area of the side-end presser portion 40B that acts on the side-end region B becomes greater than that of the center presser portion 40C that acts on the center region C.

As a result, it is more difficult for toner to pass between the side-end region B and the side-end presser portions 40B than between the center region C and the center presser portion 40C, and the amount of toner per unit area (M/A) passing the side-end presser portions 40B is less than that passing the center presser portion 40C.

The layer thickness-regulating blade 32 of the embodiment is made up of the presser to the shape of the side-end presser portions 40B and the center presser portion 40C. A pressing force applied to the developing roller 31 can be set accordingly by portion 40 and the plate spring 59. Thus, the layer thickness-regulating blade 32 can be designed according to purpose and usage.

The developing roller 31 is supported by the housing 52 so as to rotate from a free end portion of the plate spring 59 toward the base end portion thereof. That is, toner to be supplied onto the developing roller 31 is moved toward the free end portion of the plate spring 59 to pass between the developing roller 31 and the presser portion 40.

Toner physically tends to get scraped when toner is brought in contact with the presser portion 40 along with the rotation of the developing roller 31. Therefore, the difference of the amount of toner brought between the center region C and the side-end region B, which is caused by the difference in the pressing forces therebetween, clearly appears. Consequently, the amount of toner per unit area (M/A) held in the side-end region B of the developing roller 31 after passing the layer thickness-regulating blade 32 can be simply and reliably reduced to less than that held in the center region C.

Resulting from the differences in surface roughness and hardness between the side-end region B and the center region C of the developing roller 31 and in shape between the side-end presser portions 40B and the center presser portion 40C of the presser portion 40, the amount of toner per unit area (M/A) held in the side-end region B of the developing roller 31 is kept less than that in the center region C during a period from the time when toner held on the developing roller passes the layer thickness-regulating blade 32 to the time when toner is brought into contact with the photosensitive drum 27. That is, toner in the side-end region B is thinner than that in the center region C. Specifically, toner in the side-end region B is formed to be approximately one layer, or less, thick as shown in FIG. 11A.

Figure 11A:
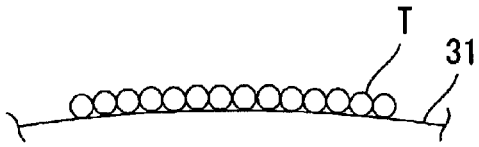
FIG. 11A is a diagrammatic illustration showing that toner particles formed into one layer, or less, are held on the surface of the developing roller.
Figure 11B:
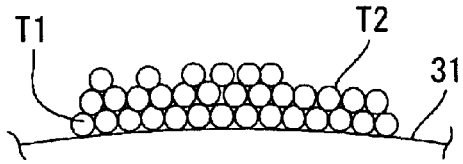
FIG. 11B is a diagrammatic illustration showing that toner particles formed into two or more layers are held on the surface of the developing roller.

If, as shown in FIG. 11B, two or more layers of toner are formed in the side-end region B, toner T1 on the first layer from the surface of the developing roller 31 is held on the surface of the developing roller 31 in a good condition because of direct contact. Toner T2 on the second layer or higher does not directly make contact with the surface of the developing roller 31 in the side-end region B, so that the second layer of toner T2 is liable to peel off the first layer of toner T1. Consequently, when toner is returned to the developing chamber 34*a* without being supplied to the photosensitive drum 27, it may be scraped off in contact with the side seal 51, the lower side seal 57, and the lower film 67 by rotation of the developing roller 31. The scraped off toner is apt to leak outside the housing 52.

However, in the embodiment, toner in the side-end region B after passing the layer thickness-regulating blade 32 is formed into an approximate one layer, or less, thickness as shown in FIG. 11A. As toner T is held on the surface of the developing roller 31 in a good condition, when returned to the developing chamber 34*a* without being supplied to the photosensitive drum 27, it resists being scraped off by the side seal 51, the lower side seal 57, and the lower film 67. Thus, leakage of toner from the housing 52 is prevented.

Toner being formed into an approximate one layer, or less, thickness means that the one layer also includes an incomplete layer where toner particles are not partially held on the surface in the side-end region B.

The amount of toner per unit area (M/A) can be determined as follows:

Toner held on the roller portion 69 during a period from the time when toner passes the layer thickness-regulating blade 32 to the time when toner is brought into contact with the photosensitive drum 27, is picked up in a certain spot by a suction device, for example, and the weight of the toner picked up is measured.

A strip of mending tape (manufactured by 3M Corporation) is affixed on the surface of the roller portion 69 of which the toner has been removed by suction, and then peeled off.

On the adhesive side of the strip of mending tape, an area from which toner is not adhered, in other words, an area from which toner has been removed by suction, is measured. The amount of toner per unit area (M/A) is calculated from the weight of toner and the area from which toner has been removed.

According to the embodiment, the amount of toner per unit area (M/A) held in the side-end region B of the developing roller 31 after passing between the layer thickness-regulating blade 32 and the developing roller 31 is less than that in the center region C. That is, toner held in the side-end region B is thinner than that in the center region C.

Thus, toner held in the side-end region B of the developing roller 31 resists being scrapped off even if it makes sliding contact with the side seal 51, the lower side seal 57, and the lower film 67. Even if the laser printer 1 is used for a long term, leakage of toner from the housing 52 can be reliably prevented.

The boundary between the upstream end portion 71 of the side-end presser portion 40B and the upstream end portion 72 of the center presser portion 40C, which comprise layer thickness-regulating blade 32, is discontinuous and stepped. The upstream end portions 71, 72 are formed differently from each other in cross section in the lengthwise direction of the presser portion 40. Thus, the boundary between the portions of the side-end region B pressed by the side-end presser portions 40B and the center region C pressed by the center presser portion 40C is clearly defined on the surface of the developing roller 31.

That is, the amount of toner per unit area (M/A) held in the portions of the side-end region B pressed with a great force by the side-end presser portions 40B and the amount of toner per unit area (M/A) held in the center region C pressed with a small force by the center presser portion 40C are clearly differentiated.

If the boundary between the side-end presser portion 40B and the center presser portion 40C is formed in a continuously tilted line along the width of the presser portion 40, the amount of toner per unit area (M/A) held in the side-end region B continuously becomes less than that in the center region C, and the boundary becomes fuzzy.

In other words, if the amount of toner is set such that it is maintained at a level sufficient for development in the center region C, the amount of toner held in the side-end region B may be formed into not a single layer, as shown in FIG. 11A, but a plurality of layers, causing leakage of toner by sliding contact with the side seal 51, the lower side seal 57, and the lower film 67. On the other hand, if the amount of toner is set such as to form one layer of toner in the side-end region B, the amount of toner held on both ends of the center region C may be insufficient for development, resulting in an image of poor quality.

According to the embodiment, as the boundary between the side-end presser portion 40B and the center presser portion 40C is clearly defined, the boundary between the center region C where the toner layer is thick and the amount of toner per unit area (M/A) is great and the side-end region B where the toner layer is thin and the amount of toner per unit area (M/A) is small is also clearly defined. Thus, the amount of toner per unit area (M/A) in the side-end region B is set to a degree that prevents leakage of toner in sliding contact with the side seal 51, the lower side seal 57, and the lower film 67, and the amount of toner per unit area (M/A) in the center region C is sufficient to form a preferable image. Leakage of toner is prevented and images of high quality are produced.

The sealing element 66 making sliding contact with the seal region A of the developing roller 31 is made of a textile. Even if toner held in the side-end region B comes to contact the sealing element 66, leakage of the toner is prevented because the sealing element 66 securely adheres to the seal region A.

A portion of the side-end region B is formed at both outer ends of the axial direction of the developing roller 31 as a region that does not overlap the first region M corresponding to a region where an electrostatic latent image is formed on the photosensitive drum 27 nor the second region N corresponding to the maximum width of the sheet 3. Therefore, there is little likelihood of improper image formation near the edge of the sheet 3 resulting from the difference of the amount of toner between the side-end region B and the center region C. Thus, images are produced in good condition.

Leakage of toner outside the housing 52 is prevented as long as an arrangement is provided such as to hold approximately one layer, or less, of toner in at least the portion of the side-end region B adjacent to the seal region A. Depending on the purpose and usage, toner held in the center region C is at least as thick as that in the side-end region B.

The laser printer 1 of the embodiment is provided with the developing cartridge 28 including the developing roller 31 and the layer thickness-regulating blade 32 described above, thereby preventing toner from dispersing inside the casing 2. Thus, the laser printer 1 can reliably operate. Even if the laser printer 1 is used for a long term, leakage of toner is reliably prevented and dispersion of toner inside the casing 2 is effectively prevented.

In the above embodiment, the sealing element 66 is made of cashmere-base textile fabric, however, it may be a felt, knit, hair implant, nonwoven material, and other media as long as it is made of cashmere-base fibers, TEFLON®-base fibers, or polyester-base fibers. Several examples of the sealing element 66 are disclosed in U.S. patent application Ser. No. 10/106,238, the disclosure of which is incorporated by reference herein in its entity.

While the invention has been described in detail and with reference to specific embodiments thereof, it will be apparent to those skilled in the art that various changes, arrangements and modifications may be applied therein without departing from the spirit and scope of the invention.

What is claimed is:

1. A developing cartridge, comprising:

a housing that accommodates developer therein;

a developing roller, rotatably supported in the housing, that holds the developer on a circumferential surface thereof; and a side seal provided at both lengthwise ends of the developing roller, the circumferential surface of the developing roller being divided into a seal region at each end of the developing roller, a side-end region at a center facing side of the seal region at each end of the developing roller, and a center region between the side-end regions, the seal region making sliding contact with the side seal at each end of the developing roller, wherein a hardness in the side-end region of the developing roller is larger than a hardness in the center region of the developing roller.

2. The developing cartridge according to claim 1, wherein a hardness in the seal region of the developing roller is larger than a hardness in the center region of the developing roller.

3. The developing cartridge according to claim 1, wherein a roughness in the side-end region of the developing roller is smaller than a roughness in the center region of the developing roller.

4. The developing cartridge according to claim 3, wherein a roughness in the seal region of the developing roller is smaller than the roughness in the center region of the developing roller.

5. The developing cartridge according to claim 2, wherein a roughness in the side-end region of the developing roller is smaller than a roughness in the center region of the developing roller.

6. The developing cartridge according to claim 5, wherein a roughness in the seal region of the developing roller is smaller than the roughness in the center region of the developing roller.

7. A developing cartridge, comprising:

a housing that accommodates developer therein;

a developing roller, rotatably supported in the housing, that holds the developer on a circumferential surface thereof;

a side seal provided at both lengthwise ends of the developing roller, the circumferential surface of the developing roller being divided into a seal region at each end of the developing roller, a side-end region at a center facing side of the seal region at each end of the developing roller, and a center region between the side-end regions, the seal region making sliding contact with the side seal at each end of the developing roller; and a regulating member that contacts the circumferential surface of the developing roller to form a thin layer of the developer on the circumferential surface of the developing roller, wherein the regulating member further comprises:

a side-end presser portion formed at each end of the regulating member to contact an opposed side-end region of the developing roller; and a center presser portion formed between the side-end presser regions to contact the center region of the developing roller, wherein a pressing force per unit area of the side-end presser portions that act on the side-end regions of the developing roller is greater than a pressing force per unit area of the center presser portion that acts on the center region of the developing roller.

8. A developing cartridge, comprising:

a housing that accommodates developer therein;

a developing roller, rotatably supported in the housing, that holds the developer on a circumferential surface thereof;

a side seal provided at both lengthwise ends of the developing roller, the circumferential surface of the developing roller being divided into a seal region at each end of the developing roller, a side-end region at a center side of the seal region at each end of the developing roller, and a center region between the side-end regions, the seal region making sliding contact with the side seal at each end of the developing roller; and a regulating member that contacts the circumferential surface of the developing roller to form a thin layer of the developer on the circumferential surface of the developing roller, wherein the regulating member further comprises:

a side-end presser portion formed at each end of the regulating member to contact an opposed side-end region of the developing roller; and a center presser portion formed between the side-end presser regions to contact the center region of the developing roller, wherein an upstream side of each side-end presser portion with respect to rotational direction of the developing roller is formed with a different shape than an upstream side of the center presser portion.

9. The developing cartridge according to claim 8, wherein the upstream side of each side-end presser portion and the upstream side of the center presser portion are formed in a discontinuous chain of different forms in cross section.

10. The developing cartridge according to claim 9, wherein a first angle formed by the upstream side of each side-end presser portion and a first tangent line at a nip portion between the developing portion and the regulating member is smaller than a second angle formed by the upstream side of each side-end presser portion and a second tangent line at the nip portion.

11. The developing cartridge according to claim 9, wherein a radius of the upstream side of each side-end presser portion is smaller than a radius of the upstream side of the center presser portion.

12. The developing cartridge according to claim 8, wherein the regulating member further comprises: a plate, one end of which is supported at the housing, that holds the side-end presser portion and the center presser portion at the other end thereof.

13. The developing cartridge according to claim 12, wherein the developing roller rotates in a direction from the other end of the plate toward the one end of the plate.

14. The developing cartridge according to claim 8, wherein the side seal is adhered to the regulating member.

15. A developing cartridge, comprising:

a housing that accommodates developer therein;

a developing roller, rotatably supported in the housing, that holds the developer thereon; and a side seal provided at both lengthwise ends of the developing roller, wherein a number of layers of the developer held on the developing roller adjacent to the side seal is no more than one.

16. The developing cartridge according to claim 15, further comprising:

a lower film contacting a circumferential surface of the developing roller in a lengthwise direction of the developing roller; and a lower side seal contacting the side seal and the lower film.

17. The developing cartridge according to claim 15, wherein the developer is substantially spherical and made by copolymerization.

* * * * *